US009469510B2

(12) United States Patent
Phillip

(10) Patent No.: US 9,469,510 B2
(45) Date of Patent: Oct. 18, 2016

(54) WALL PANEL CONSTRUCTION ACCESSORIES

(71) Applicant: Wall Ace, LLC, Iron Ridge, WI (US)

(72) Inventor: Kristopher Phillip, Iron Ridge, WI (US)

(73) Assignee: Wall Ace, LLC, Iron Ridge, WI (US)

( * ) Notice: Subject to any disclaimer, the term of this patent is extended or adjusted under 35 U.S.C. 154(b) by 0 days.

(21) Appl. No.: 14/833,907

(22) Filed: Aug. 24, 2015

(65) Prior Publication Data

US 2016/0053502 A1 Feb. 25, 2016

Related U.S. Application Data

(60) Provisional application No. 62/040,489, filed on Aug. 22, 2014.

(51) Int. Cl.

| | |
|---|---|
| ***B66C 1/22*** | (2006.01) |
| ***E04G 21/18*** | (2006.01) |
| ***B66C 1/62*** | (2006.01) |
| ***B66C 1/24*** | (2006.01) |

(52) U.S. Cl.
CPC . *B66C 1/22* (2013.01); *B66C 1/24* (2013.01); *B66C 1/62* (2013.01); *E04G 21/18* (2013.01)

(58) Field of Classification Search
CPC ... E04F 21/18; E04F 21/185; E04F 21/1894; B66C 1/22; B66C 1/28; B66C 1/30; B66C 1/62; B66C 1/64; B66C 1/66; B66F 15/00; E04G 21/16; E04G 21/18
USPC ..... 294/67.1, 17; 254/15, 113, 119; 414/11; 52/125.6
See application file for complete search history.

(56) References Cited

U.S. PATENT DOCUMENTS

| | | | | |
|---|---|---|---|---|
| 2,046,516 A | | 7/1936 | Johnson | |
| 2,583,945 A | | 1/1952 | Jacob | |
| 2,589,954 A | * | 3/1952 | Neil | B66C 1/24 29/429 |
| 2,945,662 A | | 7/1960 | Jennings | |
| 3,437,296 A | | 4/1969 | Hinz | |

(Continued)

*Primary Examiner* — Dean Kramer
(74) *Attorney, Agent, or Firm* — Boyle Fredrickson, S.C.

(57) ABSTRACT

Lumber construction tools that facilitate lifting and manipulating wall sections and discrete structures of the lumber assembly. One of the construction tools discloses a wall lifting appliance or device for raising timber framed wall structures from a horizontal to a vertical position without unduly interfering with placement of sheathing on the framed wall sections. A construction lumber biasing tool is also disclosed that includes a handle portion and a offset portion that cooperate with one another and the lumber members to facilitate deflection or deformation of warped or curved lumber members to achieve the desired orientation of the lumber relative to adjacent members.

20 Claims, 8 Drawing Sheets

(56) References Cited

U.S. PATENT DOCUMENTS

| | | | | | |
|---|---|---|---|---|---|
| 3,765,543 | A * | 10/1973 | Thomas | E04G 21/26 | 294/74 |
| 3,800,493 | A | 4/1974 | Livingston | | |
| 3,991,852 | A | 11/1976 | Brookes et al. | | |
| 4,290,582 | A * | 9/1981 | Eckelkamp | E04G 21/16 | 254/15 |
| 4,493,477 | A * | 1/1985 | Greer | B25B 9/00 | 254/113 |
| 4,671,724 | A * | 6/1987 | Bolton | B65G 59/063 | 221/283 |
| 4,733,896 | A | 3/1988 | Klein | | |
| 5,163,799 | A | 11/1992 | Lynn | | |
| 5,490,334 | A | 2/1996 | Payne | | |
| 5,566,999 | A * | 10/1996 | Goettl | B25B 5/101 | 294/103.1 |
| 5,634,301 | A | 6/1997 | Koller | | |
| 5,833,430 | A | 11/1998 | Reynolds et al. | | |
| 6,000,898 | A | 12/1999 | Sharp | | |
| 6,019,561 | A | 2/2000 | Thomson et al. | | |
| 6,089,809 | A | 7/2000 | Dellinger | | |
| 6,234,440 | B1 | 5/2001 | Boney et al. | | |
| 6,508,448 | B1 * | 1/2003 | Stewart | E04F 21/18 | 248/125.8 |
| 7,226,036 | B1 * | 6/2007 | Wellman, Jr. | E04G 21/167 | 254/120 |
| 7,832,702 | B2 | 11/2010 | Yates | | |
| 8,287,221 | B1 | 10/2012 | Van Roekel | | |
| 8,720,129 | B2 | 5/2014 | Sias et al. | | |
| 2004/0094982 | A1 * | 5/2004 | Neufeldt | B66C 1/36 | 294/82.24 |
| 2012/0286119 | A1 * | 11/2012 | Scott | B25B 27/16 | 248/309.1 |

* cited by examiner

WALL PANEL CONSTRUCTION ACCESSORIES

CROSS-REFERENCE TO RELATED APPLICATIONS

This application claims priority to U.S. Provisional Patent Application Ser. No. 62/040,489 filed on Aug. 22, 2014 titled "WALL PANEL CONSTRUCTION ACCESSORIES" and the disclosure of which is incorporated herein.

BACKGROUND OF THE INVENTION

The present invention relates to devices associated with moving and positioning timber framed wall sections and devices for manipulating discrete members associated with such constructions. Commonly, during conventional timber framing practices, wall sections that consist of a sill plate, a top plate, a plurality of vertical studs, and commonly exterior sheathing materials are assembled in a horizontal configuration and subsequently tipped up or moved to a desired location associated with a vertical orientation. Although smaller wall sections can be manually manipulated, larger wall sections commonly require auxiliary equipment such as loaders, telescopic handlers, cranes or the like to effectuate movement of the wall sections from the commonly horizontal assembly location to a generally gravitationally vertical placement location.

Moving large and/or heavy wall panels with ancillary powered equipment can require the placement of one or more straps or clamp bodies that are commonly secured to the wall sections with conventional or custom fasteners or closure assemblies. Some such systems require placement or completion of the sheathing process after the wall sections have been positioned in a vertical orientation and the now elevated lifting device has been removed from the wall section. Such processes can be considerably inefficient as trades persons must first reach the commonly elevated locations, perform various tasks associated with removal of the lifting device and/or any mechanical connectors associated with elevating the discrete wall section(s), place and secure any omitted sheathing or exterior finish or walling materials, and repeat multiple iterations of such activities for each wall section, for each lifting device, and for each framing project.

Accordingly, there is a need for a wall panel lifting assembly that can be conveniently and expeditiously secured and removed from discrete wall sections. There is a further need for a wall panel lifting device that cooperates with the underlying wall section in a manner that facilitates nearer completion of the wall assembly when the discrete wall section is oriented in a generally horizontal position. Such a consideration mitigates the need to fill the openings or reducing the size of the openings left in the wall assembly and associated with the lifting arrangement or device and after the wall portion has achieved a substantially more vertical orientation associated with placement of the discrete wall sections during assembly of such timber frames structures.

Another concern associated with timber frame construction practices is achieving a substantially linear association of the adjacent structures during fastening of the same. Many persons skilled in the construction trades appreciate the difficulty associated with working with nonlinear dimensional lumber. That is, dimensional lumber that is bent, curled, or otherwise warped must commonly be straightened during the fastening process to achieve the desired orientation of the discrete members relative to the resultant assembly to accommodate later construction practices. Due to warping or curling common to much dimensional lumber, it is commonly necessary to physically manipulate the position of assembled wall sections relative to other sections and/or to straighten sections of dimensional lumber or achieve a desired orientation of the wall section relative to a floor, deck, or a cap associated with previously existing or assembled sections. Although some such deviations of the dimensional lumber can be addressed by physical manipulation of the discrete members, other structures or the degree of deviation can require the use of ancillary tools or straps to provide a lever association wherein interaction with a cantilevered end of the lever and effectuate the desired manipulation of the timber members.

Use of lever arrangements commonly requires securing one end of the lever member to the deformed member and physical manipulation of the remote end of the lever to achieve the desired manipulation of the deformed member. Such practices require providing a secure connection to the deformed member wherein the connection must be robust enough to withstand the forces associated with the deformation practices. Unfortunately, such practices commonly result in deformation of the fasteners which in turn detracts from the ability to expeditiously remove the lever from the framing members once the deformed member is secured to the remaining frame in a manner sufficient to maintain the desired position of the deformed member. Such practices are further complicated where the degree of deformation cannot be resolved by a single tradesperson.

That is, it is preferable to provide a deformation correction wherein a single tradesperson can effectuate the desired manipulation of the deformed material and secure the discrete frame members during physical manipulation of the same. Such practices commonly require a single tradesperson to deform the discrete member to a straight configuration and effectuate operation or manipulation of securing tools, whether braces, drills, straps, pneumatic nailers, hand tools, or the like with a free hand. Alternatively, two tradespersons are required to effectuate such a process wherein one tradesperson effectuates the correcting deformation and the other tradesperson effectuates the securing process. The two tradesperson corrective action detracts from efficient use of staff and crew personnel. Therefore, there is also a need to provide a construction accessory associated with manipulating timber frame members or sections which are convenient to use and do not unduly interfere with customary framing processes.

BRIEF DESCRIPTION OF THE INVENTION

The present invention provides various construction tools or accessories that overcome one or more of the drawbacks disclosed above. Lumber construction tools are disclosed that facilitate lifting and manipulating wall sections and discrete structures of the lumber assembly. One of the construction tools discloses a wall lifting appliance or device for raising timber framed wall structures from a horizontal to a vertical position without unduly interfering with placement of sheathing on the framed wall sections. A construction lumber biasing tool is also disclosed that includes a handle portion and a offset portion that cooperate with one another and the lumber members to facilitate deflection or deformation of warped or curved lumber members to achieve the desired orientation of the lumber relative to adjacent members. The construction tools disclosed herein improve timber construction practice and utilization of personnel efficiencies.

Another aspect that is usable in combination with one or more of the above aspects discloses a wall lifting system. The wall lifting system includes a rail having a first longitudinal end and a second longitudinal end and is defined by a top portion, a bottom portion, and a side portion. The respective top, bottom, and side portions are connected to one another such that the top portion and the bottom portion are substantially parallel to one another and extend the same distance from the side portion and such that the side portion is substantially perpendicular to each of the top portion and the bottom portion to define a substantially orthogonal C-shaped channel. The rail is shaped to slideably cooperate with a top plate of a framing structure such that the timber associated with top plate is securely received in the C-shaped channel. A flexible connector includes opposite ends that are permanently affixed proximate the opposite longitudinal ends of the top portion of the rail. The flexible connector has a length that is sufficient to provide a gap between a center section of the flexible connector and an outer directed surface of top portion of the rail such that the flexible connector can removably cooperate with a lifting means, such as a crane, a lift, a loader, or connectors such as cables, slings, chains, straps, associated with being connected to the same associated with rotating an assembled framing structure from a horizontal position to a vertical position.

A further aspect that is usable with one or more of the above aspects discloses a wall lifting device that includes a rail defined by three closed sides and an open side wherein two of the sides are parallel to one another and the third side is perpendicular to each of the two parallel sides. The two parallel sides of the rail each extend an equal distance from the third side and the third side has a width that allows a top plate of a wall section formed by dimensional lumber to be disposed between the two parallel sides when a vertical edge of the top plate is adjacent the third side. A chain is connected to a surface of one of the parallel sides that faces away from the second of the two parallel sides. Opposite longitudinal ends of the chain are connected to opposite longitudinal ends of the rail and the chain is longer than the rail to provide a gap between a center section of the chain and the rail. A tooth extends from the second of the two parallel sides and toward the side associated with the chain. The tooth is configured to engage a downward facing side of the top plate of the wall section during lifting of the wall section.

Another aspect of the invention that is useable with one or more of the above aspects discloses a construction lumber biasing tool that is defined by a handle section and an offset section that are pivotably connected to one another. A handle is formed at one end of the handle section and at least one barb is formed at a second end of the handle section. A first end of the offset section is pivotably connected to the handle section near the at least one barb and a second end of the offset section has at least one barb formed thereat such that the at least one barb associated with the handle section and the at least one barb of the offset section face in a common direction at a location opposite the handle associated with the handle section.

These and other features, aspects, and advantages of the present invention will be better understood from the following brief description of the drawings, drawings, and detailed description of the preferred embodiments of the present invention.

BRIEF DESCRIPTION OF THE DRAWING

The drawings illustrate preferred embodiments presently contemplated for carrying out the invention.

In the drawings.

DETAILED DESCRIPTION OF THE PREFERRED EMBODIMENTS

Figure 1:
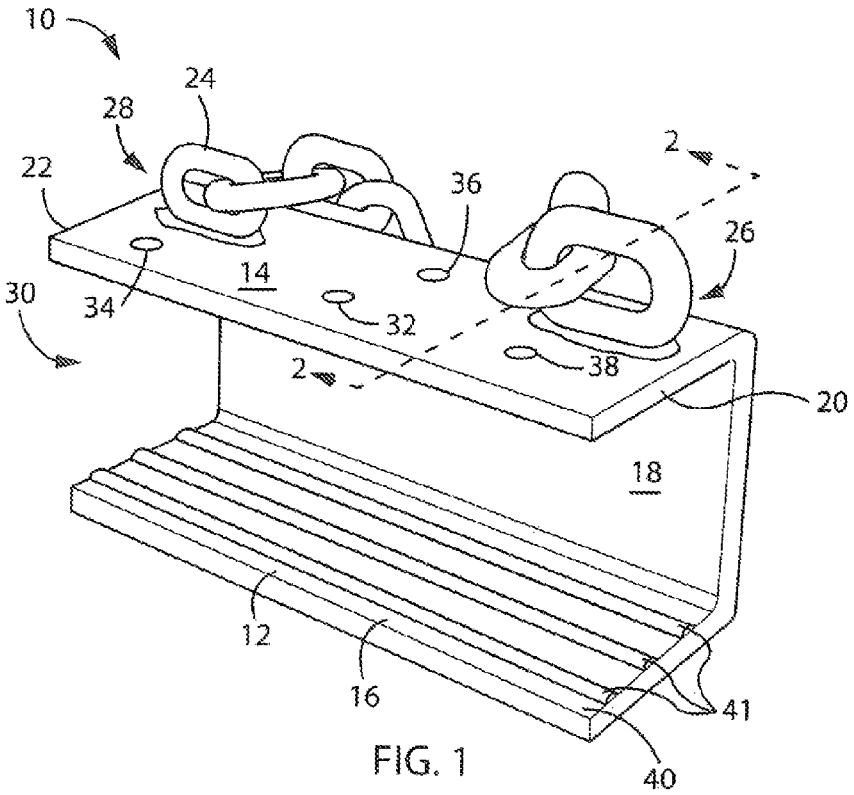
FIG. 1 is a side perspective view of a wall section lifting device associated with the lumber construction accessory tool system according to one embodiment to the present invention.
Figure 2:
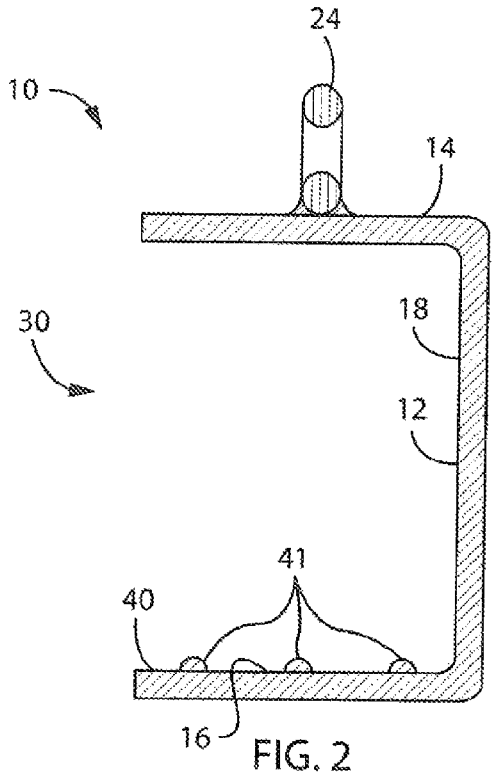
FIG. 2 is a side elevation sectional view of the wall lifting device shown in FIG. 1 taken along line 2-2.

FIGS. 1 and 2 show a wall lifting system or device 10 according to a first aspect of the present invention. Device 10 includes a rail 12 that is generally defined by a top section 14, a bottom section 16, and a side section 18 that each extend the longitudinal length of the rail 12. Rail 12 is defined by a first longitudinal end 20 and a second longitudinal end 22. A flexible connector 24, such as a chain, includes a first end 26 and a second end 28 that are each permanently secured to rail 12 proximate a respective one of ends 20, 22. Connector 24 is further secured to an exterior or outwardly facing side of top section 14 of rail 12 such that connector 24 is easily accessible during lifting of the wall sections.

Top section 14 and bottom section 16 of rail 12 are offset from one another approximately 3 inches attributable to a lateral height of center section 18 to define a channel 30 therebetween. Channel 30 preferably has a depth that is no greater than 3½ inches such that channel 30 can cooperate with 2×4 dimensional lumber without interfering with the customary placement of sheathing with an underlying timber stud or wall structure. Understandably, devices could be provided in various configurations, such as having depths or 5½ or 7½ inches, for cooperation with dimension lumber having other dimensions, such as 2×6's or 2×8's as the situation or construction configuration may require. It is further appreciated that device 10 can be provided in other vertical dimensions for cooperation with top plates having thicknesses other than the approximate 3 inch dimension associated with a two member top plate construction. Understandably, such dimensions are only exemplary.

Regardless of the specific dimension, channel 30 has a rectilinear shape such that the section of channel near side wall or section 18 has a similar dimension as a dimension associated with the distance between the cantilevered edges of top section 14 and bottom section 16. Said in another way, any chamfer or radius associated with the intersection of top and bottom sections 14, 16 with side section 18 is negligible or otherwise configured to be only minimally greater than the chamfered dimension commonly associated with the lateral edges of dimension lumber.

It has been shown that C-shaped or I-shaped channel materials are commonly provided with an interior facing chamfer or radius that detracts from the desired placement of device 10 relative to the underlying framing. That is, various manufacturing processes and load rating requirements of such rail sections commonly require an internal facing chamfer or radius at the intersection between the discrete portions of such rails or beams. Such structures detract from the ability to orient the interior facing side of section 18 in close if not touching proximity to the timber framing and detrimentally affect the ability of the rail sections to withstand the bending and torsional loading associated with lifting wall panels when the top plate is captured between the opposing faces of the rail but remains offset from the connecting wall or web associated with the underlying rail. Such detriments increase the cost associated with forming such a device and result in a heavier than necessary assembly that increases user fatigue.

Channel 30 is constructed to slidably cooperate with a top plate of a framed wall section is described further below. Top section 14 can include one or more holes 32, 34, 36, 38 that are shaped to cooperate with fasteners, such as nails or screws, associated with temporarily securing device 10 relative to a timber framed top plate. It should be appreciated that the fasteners associated with holes 32, 34, 36, 38 are generally incapable of solely supporting the load associated with an underlying wall panel assembly. It is further appreciated that an interior facing surface 40 of bottom section 16 could include one or more barbs 41 or projections associated with removably engaging the timber members associated with the top plate of a framed wall section. Barbs 41 are constructed to interfere with the underlying dimensional lumber and thereby prevent undesired lateral translation of the top plate relative to channel 30 during lifting operations.

Figure 3:
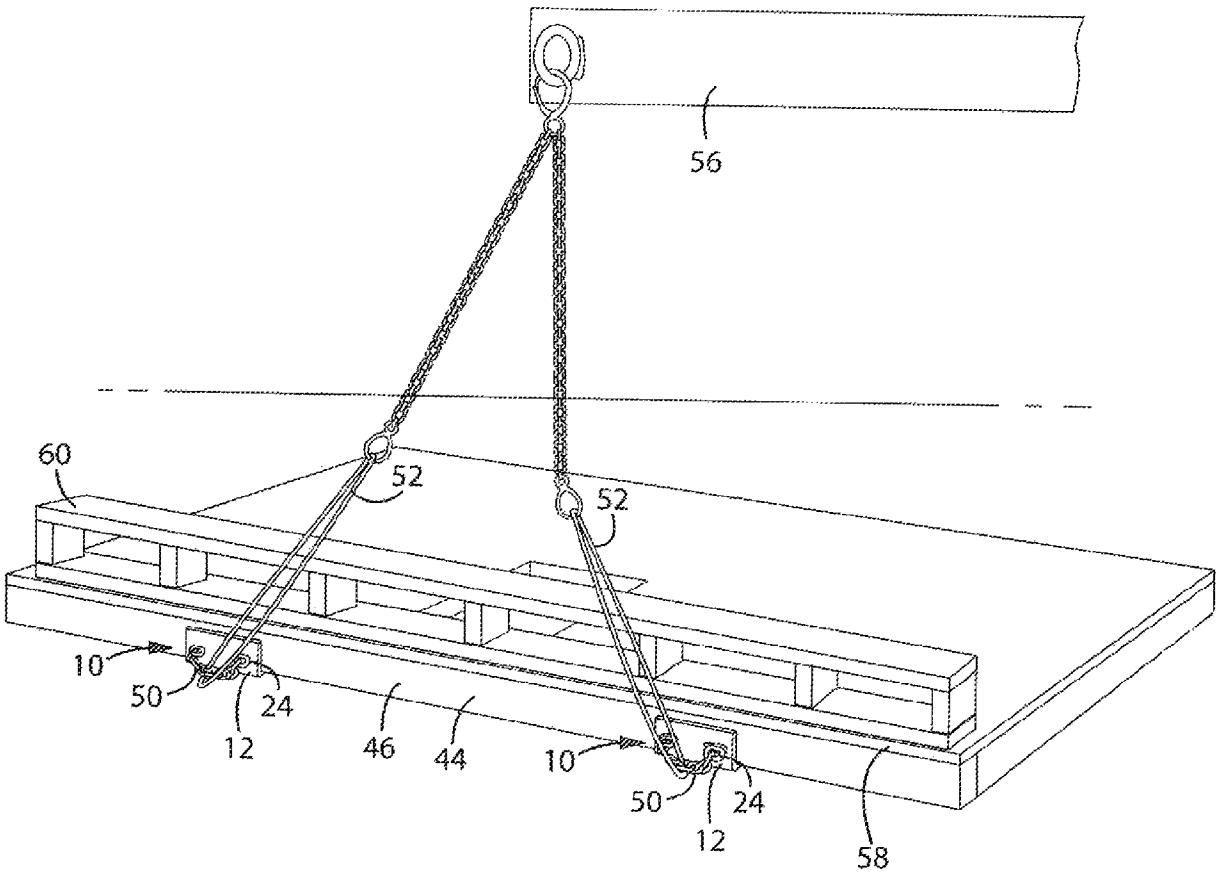
FIG. 3 is a perspective view of a pair of wall section lifting devices shown in FIG. 1 engaged with a top plate of a horizontally oriented wall section.

FIG. 3 shows a timber framed wall section 44 having a pair of devices 10 associated therewith. Rail 12 of each device 10 is engaged with the top plate 46 of wall section 44 and one or more fasteners 50 are associated with holes 32, 34, 36, 38 so as to temporarily secure rail 12 relative to top plate 46. Flexible connector 24 cooperates with a lifting means or lifting arrangement 52 that is associated with a boom, loader, or other lifting appliance or means 56. As should be appreciated, rail 12 slidably cooperates with top plate 46 such that flexible connector 24 is disposed generally above top plate 46 of wall section 44 and is fully accessible to lifting arrangement 52 when wall section 44 is fully sheathed with sheathing 58 and/or includes subsequent framing assemblies such as a soffit and fascia framing 60. The flexibility of connector 24 providers point loading of the association of lifting device 10 with the lifting means thereby reducing the bending and torsional loading of lifting device 10 and minimizes jerking or unexpected shifting of the wall section during lift operations. Further, device 10 does not interfere with subsequent framing operations such as sheathing practices. It is further appreciated that device 10 is provided in a longitudinal length that is no greater than approximately 14½ inches. Preferably, device 10 is shorter than 14 inches and more preferably, device 10 is between approximately 8 to 12 inches in length. Such considerations allow device 10 to cooperate with a single respective stud cavity associated with the framed wall section such that the wall can be fully formed without the omission of a respective stud to accommodate use of device 10.

Figure 4:
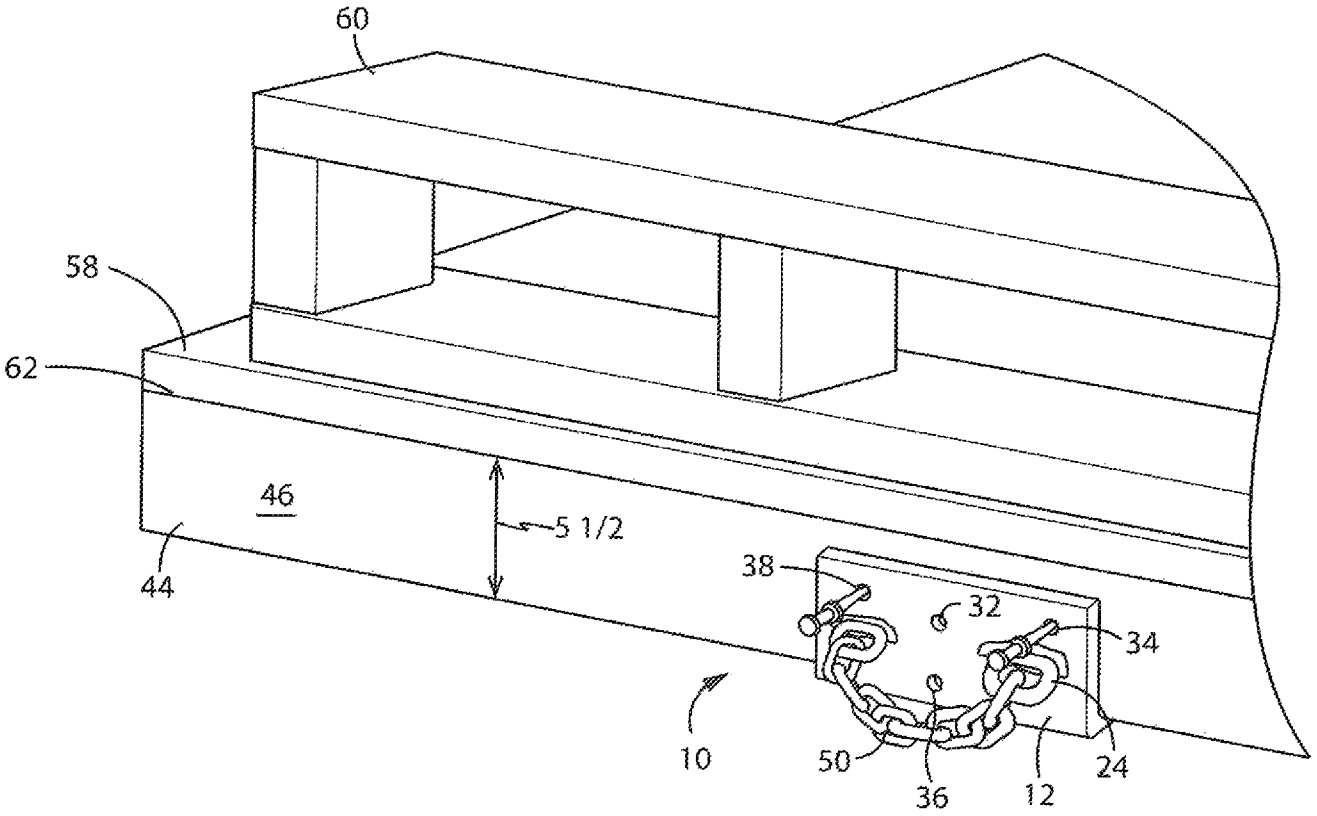
FIG. 4 is a detailed perspective view of one of the wall section lifting devices shown in FIG. 3 engaged with the top plate.

Referring to FIG. 4, it should be appreciated that wall sections 44 are commonly provided in a number of dimensional lumber framing arrangements such as 2×4, 2×6, other dimensions and combinations thereof of timber construction materials. Device 10 is constructed to slidably cooperate with the top plate 46 of such dimensional materials so as to not interfere with the application of the sheathing 58 to the timber wall framing. That is, device 10 does not extend beyond the exterior facing side 62 of the dimensional timber framing thereby accommodating completion of sheathing 58 and/or fascia and soffit framing 60 associated with customary framing practices. Further, device 10 negates the necessity of having an opening associated with the timber framing arrangement to achieve the desired orientation of respective devices 10 relative to wall section 44 for subsequent lifting practices.

Figure 5:
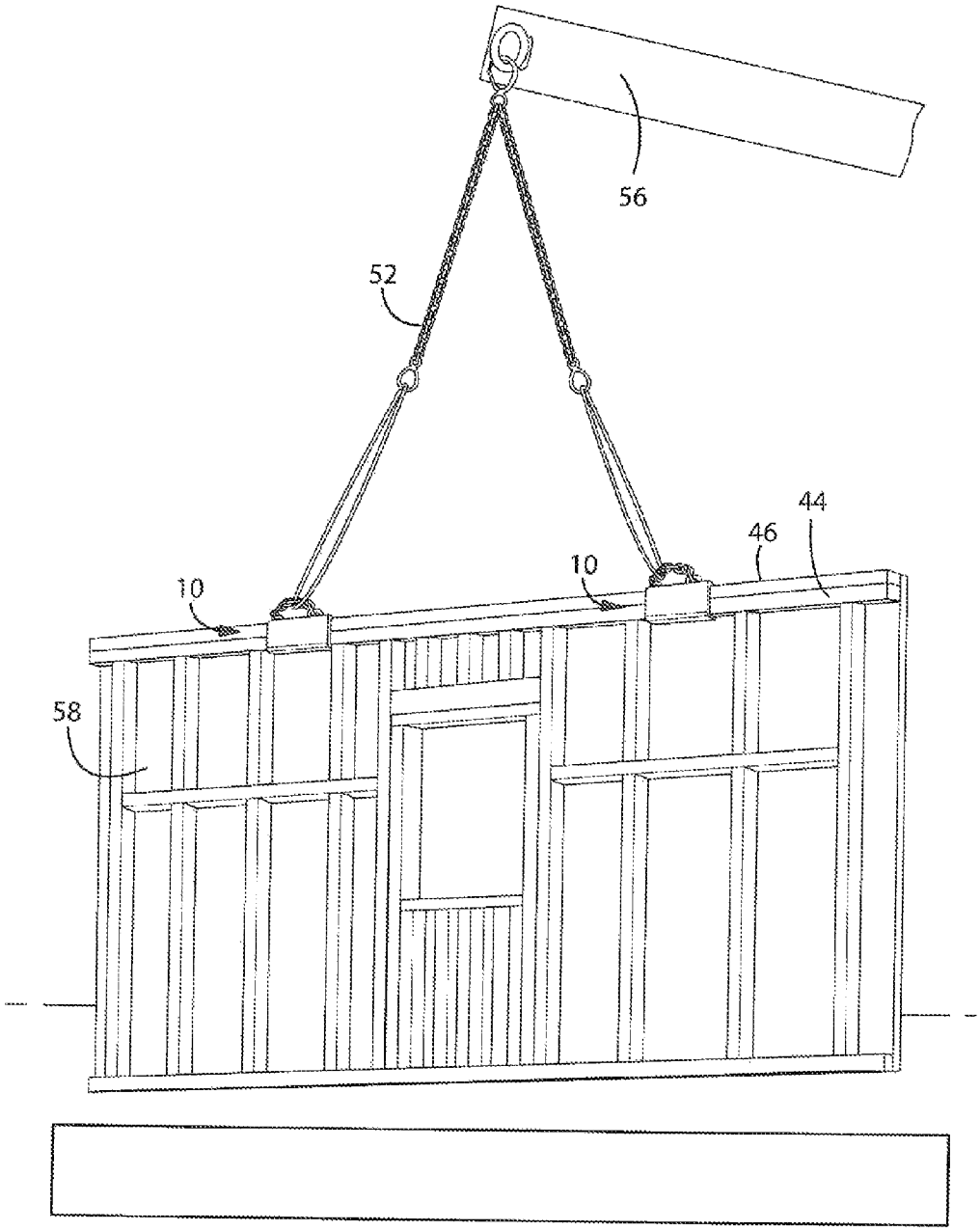
FIGS. 5 and 6 are perspective views of the wall lifting devices engaged with a lift such that the wall section is oriented in a generally vertical orientation during placement of the same.
Figure 6:
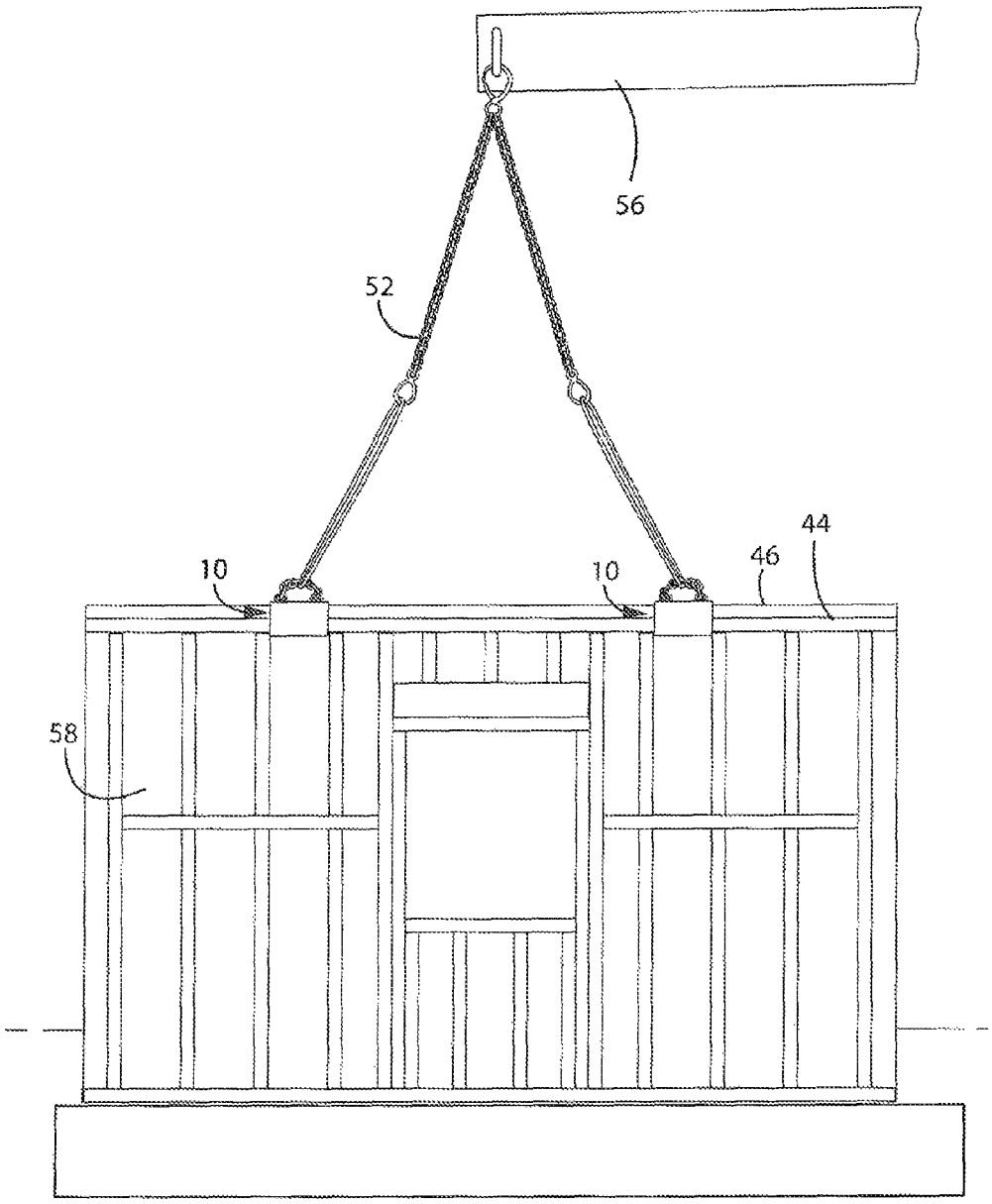

Referring to FIGS. 5 and 6, devices 10 are preferably disposed along the longitudinal length of wall section 44 to provide a generally level orientation of wall section 44 during the lifting process. As shown in FIGS. 5 and 6, those portions of wall section 44 proximate lifting devices 10 are complete inasmuch as sheathing 58 extends a desired height so as to be secured to top plate 46 of wall section 44 at locations proximate devices 10. It should further be appreciated that, once placed, devices 10 are removable from top plate 46 from a position generally laterally inward relative to wall section 44 thereby negating the need of users or tradespersons to be oriented toward an environment facing side of the placed wall section. Such a configuration provides a wall lifting device 10 that securely cooperates with the top plate 46 of wall section 44 and which can conveniently and expeditiously be associated with a wall section and subsequently removed therefrom after the respecting lifting, securing, and bracing processes.

Figure 7:
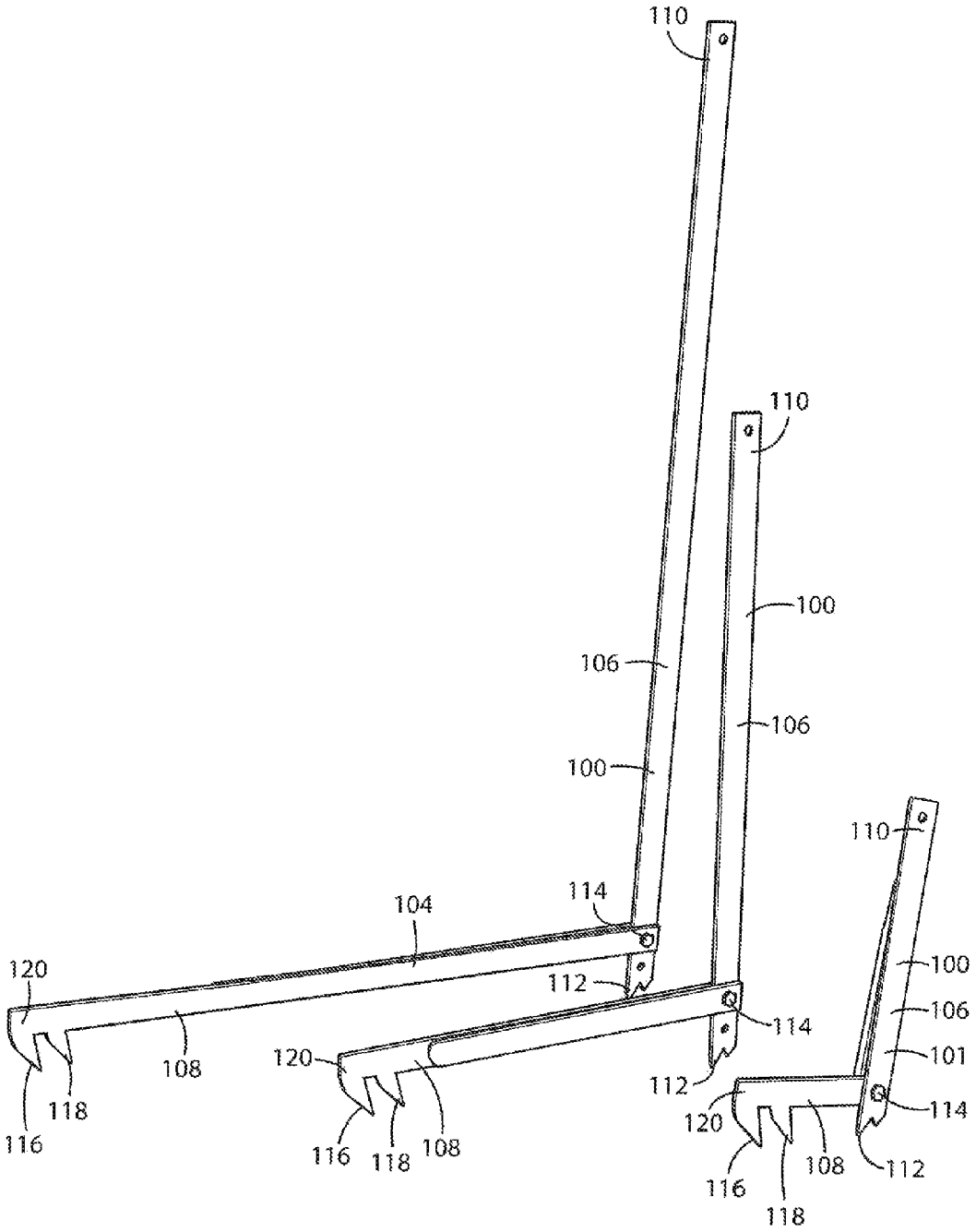
FIG. 7 is a perspective view construction lumber biasing tools associated with the lumber construction accessory tool system according to another aspect of the invention.
Figure 8:
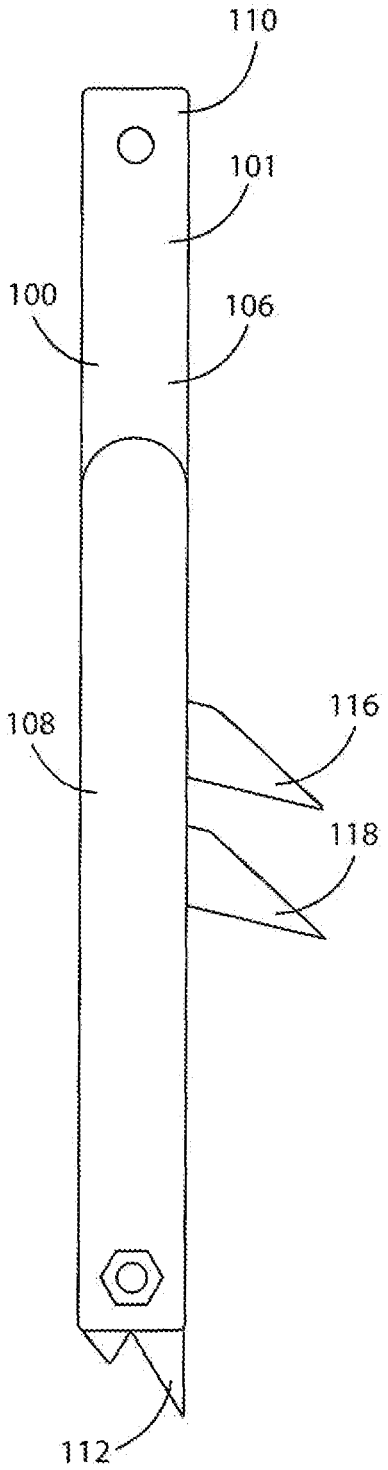
FIG. 8 is a side elevation view of one of the biasing tools shown in FIG. 7 and oriented in a stowed position.
Figure 9:
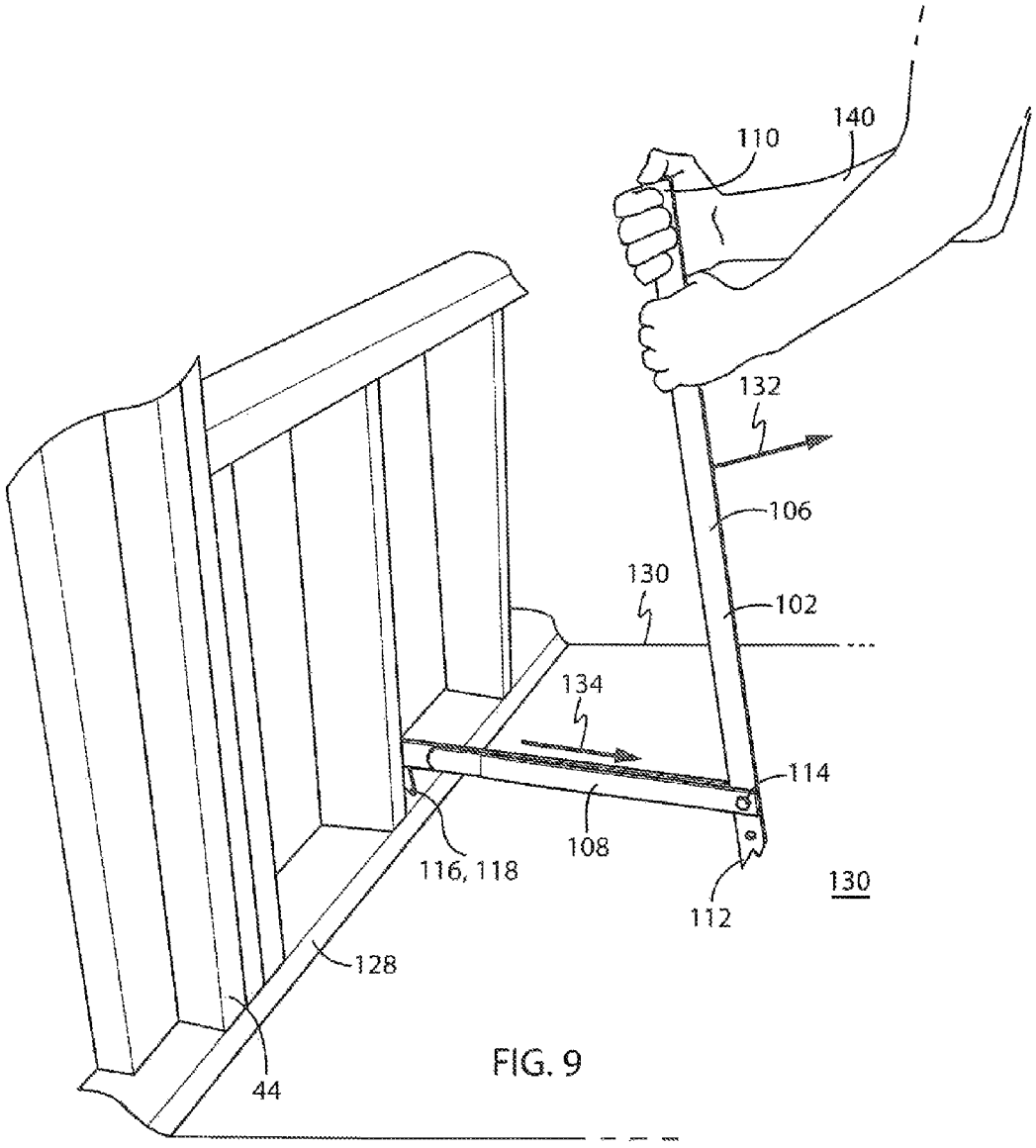
FIG. 9 is perspective view of one of the biasing tools shown in FIG. 8 engaged with a sill plate and in an in-use orientation for manipulating the orientation of the sill plate relative to a deck of a construction environment.

FIGS. 7-9 show various views of construction lumber biasing tools according to another aspect of the present invention and usable in conjunction with lifting device 10 to enhance construction practices and efficiencies. As alluded to above, during timber framing processes, it is periodically necessary to bias discrete portions of timber members and/or wall portions or sections relative to other structures or members to achieve a desired orientation of the respective member and/or wall section associated therewith relative to previously placed framing structures. FIGS. 7-9 are views of various construction lumber biasing tools according to the present invention. Each of the construction lumber biasing tools has a generally similar operation but are provided in different sizes that manipulate the mechanical advantage associated with use of any of the respective biasing tools.

As shown in FIG. 7, biasing tool 100 may be provided in various shapes or sizes such as a small 101, medium 102, and a large 104 sized biasing tool 100. Each biasing tool 101, 102, 104 includes a handle section 106 and an offset section 108 that is pivotably connected to a respective handle section 106. Each handle section 106 includes a handle 110 that is disposed at one end of the handle section 106 and at least one barb 112 that is disposed at the opposite end of the respective handle section 106.

The respective offset section 108 is connected via a pivot 114 to the respective handle section 106 proximate the respective barb 112. One or more barbs 116, 118 are formed at an end 120 of the respective offset section 108 generally opposite the respective pivot 114. FIG. 7 shows biasing tools 100, 102, 104 in generally deployed or in-use orientations whereas FIG. 8 shows biasing device 101 in a folded, stored, or stowed orientation. When in the stowed orientation, handle section 106 and offset section 108 of the respective biasing device 101, 102, 104 generally overlie one another to provide a fairly compact and generally flat orientation of the respective biasing device 100. Preferably, each biasing device 101, 102, 104, regardless of the size associated therewith, can achieve the fairly compact stored orientation shown in FIG. 8.

FIG. 9 shows biasing device 102 in an in use orientation wherein the one or more barbs 116, 118 associated with offset section 108 are engaged with the bottom or sill plate 128 associated with wall section 44 and barb 112 associated with handle section 106 is engaged with another framing surface such as a previously placed cap, floor, or deck 130 surface. It is further appreciated that other structures or surfaces may be used when a respective offset section 108 is engaged with a first structure and respective handle section 106 is engaged with another structure. Biasing handle section 106 in an inward direction relative to the wall section, indicated by arrow 132, when barb 112 is engaged with deck 130, biases sill plate 128 in an inward lateral direction, indicated by arrow 134, relative to deck 130 thereby deflecting the timber associated with sill plate 128 from an undesirable or undesirable at rest position toward a desired finished orientation relative to deck 130. It is further appreciated that biasing devices 100 can be used to achieve a desired position of one structure relative to another structure during any number of processes associated with timber framing practices.

The distance between pivot 114 and handle 110, and the interaction of barbs 112 and 116, 118 with the respective frame or decking materials, provide a user 140 with a desired mechanical advantage associated with achieving a desired deflection of sill plate 128 relative to deck 130 to attain the desired orientation of sill plate 128 relative to deck 130 prior to securing of the same. User size and strength aside, biasing devices 101, 102, 104 provide various degrees of mechanical advantage to attain a desired degree of deflection or movement of the timber members toward a final desired position or orientation.

Each biasing device 101, 102, 104 is constructed to cooperate with construction materials in a manner such that the utilization of a respective biasing device requires no modification of the underlying timber framed construction to effectuate the desired cooperation of the respective biasing tool therewith. It is further appreciated that the handle section, the offset section, and the pivot be constructed of materials and/or cross-sectional sizes and shapes selected to withstand the forces associated with the biasing activity without deforming the respective biasing tool and to maintain the movability of the respective sections thereof between the stowed and in-use configurations as disclosed above.

It is further appreciated that cooperation of the barbs with the respective adjacent framing materials, and removal of the same, can be efficiently effectuated by body weight or customary tools such as a hammer or the like. Further, it should be readily appreciated that any marring associated with use of the respective biasing device need not be repaired as the same is customarily concealed behind finish materials. Accordingly, each biasing tool 101, 102, 104 allows physical manipulation of the underlying timber materials in an efficient manner and in a manner that does not otherwise interfere with customary timber framing practices or require extraneous fastening arrangements.

Therefore, one embodiment of the invention includes a wall lifting system that includes a rail having a first longitudinal end and a second longitudinal end and that is defined by a top portion, a bottom portion, and a side portion. The respective top, bottom, and side portions are connected to one another such that the top portion and the bottom portion are substantially parallel to one another and extend the same distance from the side portion and such that the side portion is substantially perpendicular to each of the top portion and the bottom portion to define a substantially orthogonal C-shaped channel. The rail is shaped to slideably cooperate with a top plate of a framing structure such that the timber associated with top plate is securely received in the C-shaped channel. A flexible connector includes opposite ends that are permanently affixed proximate the opposite longitudinal ends of the top portion of the rail. The flexible connector has a length that is sufficient to provide a gap between a center section of the flexible connector and an outer directed surface of top portion of the rail such that the flexible connector can removably cooperate with a lifting means associated with rotating an assembled framing structure from a horizontal position to a vertical position.

Another embodiment of the invention that is usable with one or more of the above aspects includes a wall lifting device having a rail defined by three closed sides and an open side wherein two of the sides are parallel to one another and the third side is perpendicular to each of the two parallel sides. The two parallel sides of the rail each extend an equal distance from the third side and the third side has a width that allows a top plate of a wall section formed by dimensional lumber to be disposed between the two parallel sides when a vertical edge of the top plate is adjacent the third side. A chain is connected to a surface of one of the parallel sides that faces away from the second of the two parallel sides. Opposite longitudinal ends of the chain are connected to opposite longitudinal ends of the rail and the chain is longer than the rail to provide a gap between a center section of the chain and the rail. A tooth extends from the second of the two parallel sides and toward the side associated with the chain. The tooth is configured to engage a downward facing side of the top plate of the wall section during lifting of the wall section.

Another embodiment of the invention that is useable with one or more of the above embodiments includes a construction lumber biasing tool that is defined by a handle section and an offset section that are pivotably connected to one another. A handle is formed at one end of the handle section and at least one barb is formed at a second end of the handle section. A first end of the offset section is pivotably connected to the handle section near the at least one barb and a second end of the offset section has at least one barb formed thereat such that the at least one barb associated with the handle section and the at least one barb of the offset section face in a common direction at a location opposite the handle associated with the handle section.

The present invention has been described in terms of the preferred embodiments, and it is recognized that equivalents, alternatives, and modifications, aside from those expressly stated, are possible and within the scope of the appending claims. These and other advantages, aspects, and objectives will be further understood from the various drawings provided herewith and in view of the appending claims.

I claim:

1. A wall lifting system comprising:

a rail having a first longitudinal end and a second longitudinal end, the rail being defined by a top portion, a bottom portion, and a side portion that are connected to one another such that the top portion and the bottom portion are substantially parallel to one another and extend a same distance from the side portion and the side portion is substantially perpendicular to each of the top portion and the bottom portion to define a substantially orthogonal C-shaped channel shaped to slidably cooperate with a top plate of a framing structure; and a flexible connector having a first end permanently affixed proximate the first longitudinal end of the top portion of the rail and a second end permanently affixed proximate the second longitudinal end of the top portion of the rail and having a length sufficient to provide a gap between a center section of the flexible connector and an outer directed surface of top portion of the rail for removably cooperating with a lifting means associated with rotating the framing structure from a horizontal orientation to a vertical orientation.

2. The wall lifting system of claim 1, further comprising at least one barb extending from the bottom portion toward the top portion.

3. The wall lifting system of claim 2 wherein the at least one barb is located nearer a free edge of the bottom portion than an edge of the bottom portion connected to the side portion.

4. The wall lifting system of claim 1 further comprising another rail and flexible connector engaged with the framing structure at a location offset from the first rail.

5. The wall lifting system of claim 1 further comprising at least one hole formed in the rail between the first longitudinal end and the second longitudinal end.

6. The wall lifting system of claim 5 further comprising a fastener constructed to pass through the at least one hole and removably cooperate with the framing structure.

7. The wall lifting system of claim 1 wherein the rail has a longitudinal length of approximately 1 foot.

8. The wall lifting system of claim 1 further comprising a plurality of barbs that extend from the rail toward the substantially orthogonal C-shaped channel and cooperate with a top plate of a framing structure when the rail is engaged therewith.

9. A wall lifting device comprising a rail defined by three closed sides and an open side, two of the sides being parallel to one another and a third side being perpendicular to each of the two parallel sides, the two parallel sides each extending an equal distance from the third side and the third side having a width that allows a top plate of a wall section formed by dimensional lumber to be disposed between the two parallel sides when a vertical edge of the top plate is adjacent the third side;

a chain connected to a surface of a first of the two parallel sides that faces away from second of the two parallel sides and opposite longitudinal ends of the chain are connected to opposite longitudinal ends of the rail, the chain being longer than the rail to provide a gap between a center section of the chain and the rail; and at least one tooth extending from the second of the two parallel sides toward the first of the two parallel sides and configured to engage a downward facing side of the top plate during lifting of the wall section.

10. The wall lifting device of claim 9 wherein the at least one tooth further comprises a plurality of teeth.

11. The wall lifting device of claim 10 wherein the plurality of teeth are oriented in a row nearer a free edge of the second of the two parallel sides than an edge associated with the third side.

12. A lumber construction tool system comprising:

a construction lumber biasing tool defined by a handle section having a handle formed at one end and at least one barb formed at a second end;

an offset section having a first end that is pivotably connected to the handle section near the at least one barb and a second end having at least one barb formed thereat such that the at least one barb associated with the handle section and the at least one barb of the offset section face in a common direction and at a location opposite the handle of the handle section; and a wall lifting device that includes a rail that is configured to slideably capture a head plate of a framing assembly and a flexible connector having opposite ends permanently affixed to an exterior side of the rail that is transverse to an opening defined by the rail.

13. The lumber construction tool system of claim 12 wherein the handle section and the offset section cooperate with one another so as to be movable between an in-use orientation and a folded orientation wherein the handle section and the offset section overlie one another and are generally aligned with each other.

14. The lumber construction tool system of claim 12 further comprising another barb formed proximate the at least one barb of the offset section.

15. The lumber construction tool system of claim 12 further comprising a pivot that extends through the handle section and the offset section at a location nearer the at least one barb of the handle section and the first end of the offset section.

16. The lumber construction tool system of claim 12 further comprising a first construction lumber biasing tool and a second construction lumber biasing tool wherein the first construction lumber biasing tool has a handle section and an offset section that are different lengths than a handle section and an offset section than the second construction lumber biasing tool.

17. The lumber construction tool system of claim 16 further comprising another construction lumber biasing tool that has a handle section and an offset section that are different lengths than the handle section and the offset section of each of the first construction lumber biasing tool and the second construction lumber biasing tool, respectively.

18. The lumber construction tool system of claim 12 wherein the wall lifting device includes at least one of at least one hole formed in the rail that is configured to selectively receive a fastener and a barb for engaging the head plate of the framing assembly.

19. The lumber construction tool system of claim 12 further comprising another wall lifting device that includes rail configured to slideably capture the head plate of the framing assembly at a location offset from the wall lifting device and a flexible connector having opposite ends permanently affixed to an exterior side of the rail of the another wall lifting device that is transverse to an opening defined by the rail of the another wall lifting device such that the wall lifting device and the another wall lifting device cooperate with the head plate of the framing assembly from a common direction.

20. The lumber construction tool system of claim 19 further comprising at least one barb formed on an interior facing side of the wall lifting device and associated with a side of the rail opposite the flexible connector.

* * * * *